US009963958B2

(12) United States Patent
Whitney et al.

(10) Patent No.: US 9,963,958 B2
(45) Date of Patent: May 8, 2018

(54) HYDROCARBON RESOURCE RECOVERY APPARATUS INCLUDING RF TRANSMISSION LINE AND ASSOCIATED METHODS

(71) Applicant: HARRIS CORPORATION, Melbourne, FL (US)

(72) Inventors: Ryan M. Whitney, Indialantic, FL (US); Keith Nugent, Palm Bay, FL (US); Ronald E. Jackson, Jr., West Melbourne, FL (US); Richard I. Harless, Melbourne, FL (US); Stephen J. Kolvek, Ridgewood, NJ (US); Arthur H. White, Township of Washington, NJ (US)

(73) Assignee: HARRIS CORPORATION, Melbourne, FL (US)

( * ) Notice: Subject to any disclaimer, the term of this patent is extended or adjusted under 35 U.S.C. 154(b) by 393 days.

(21) Appl. No.: 14/733,431

(22) Filed: Jun. 8, 2015

(65) Prior Publication Data

US 2016/0356136 A1 Dec. 8, 2016

(51) Int. Cl.
*E21B 43/24* (2006.01)
*H01P 5/02* (2006.01)
(Continued)

(52) U.S. Cl.
CPC ..... *E21B 43/2401* (2013.01); *H01P 1/045* (2013.01); *H01P 5/02* (2013.01); *H01Q 1/243* (2013.01)

(58) Field of Classification Search
CPC ..... H01P 3/06; H01P 1/0045; H01P 11/005; H01P 1/045; H01P 5/02; E21B 43/2401; H01Q 1/243
(Continued)

(56) References Cited

U.S. PATENT DOCUMENTS 2,401,572 A 6/1946 Korman
3,087,129 A * 4/1963 Maury ..... H01P 1/045 333/21 R
(Continued)

FOREIGN PATENT DOCUMENTS

EP 1779469 3/2013
EP 1664475 11/2013

OTHER PUBLICATIONS

Grant Prideco Wellbore Casing, online catalog, 2015, 2 pp, National Oilwell Varco, available at www.nov.com/grantprideco.
(Continued)

*Primary Examiner* — Benny Lee
*Assistant Examiner* — Jorge Salazar, Jr.
(74) *Attorney, Agent, or Firm* — Allen, Dyer, Doppelt + Gilchrist, P.A.

(57) ABSTRACT

An apparatus for hydrocarbon resource recovery from a subterranean formation includes a radio frequency (RF) source, an RF antenna to be positioned within the subterranean formation to deliver RF power to the hydrocarbon resource within the subterranean formation, and an RF transmission line extending between the RF source and the RF antenna. The RF transmission line may include RF transmission line sections coupled together in end-to-end relation. Each section may include an inner conductor, an outer conductor surrounding the inner conductor, and an outer load-carrying tubular member surrounding the outer conductor. A respective coupling assembly joins ends of adjacent sections together. Each coupling assembly may include an electrical coupler being fixedly connected to first ends of corresponding inner and outer conductors and being slidably connected to opposing second ends of adjacent inner and outer conductors, and a mechanical coupler con-
(Continued)

necting ends of adjacent load-bearing tubular members together.

26 Claims, 4 Drawing Sheets

(51) Int. Cl.
*H01P 1/04* (2006.01)
*H01Q 1/24* (2006.01)

(58) Field of Classification Search
USPC ..... 333/243, 244, 260, 24 R; 340/854.9; 166/248, 60
See application file for complete search history.

(56) References Cited

U.S. PATENT DOCUMENTS 3,610,807 A 10/1971 Whitehead
3,730,965 A 5/1973 Christofferson
3,820,827 A 6/1974 Boelkins
4,412,717 A 11/1983 Monroe
4,543,548 A 9/1985 Seal et al.
4,596,435 A 6/1986 Bickford
4,721,829 A 1/1988 Meyer et al.
4,861,271 A 8/1989 Bogar et al.
5,401,173 A 3/1995 Grandchamp et al.
5,466,890 A 11/1995 Stagnitti
6,331,123 B1 12/2001 Rodrigues
7,121,881 B2 10/2006 Jones
7,649,475 B2 1/2010 Hall et al.
7,993,159 B2 8/2011 Chawgo
8,616,273 B2 12/2013 Trautman et al.
8,847,711 B2 9/2014 Wright et al.
8,960,272 B2 2/2015 Wright et al.
8,960,291 B2 2/2015 Parsche
2007/0241560 A1 10/2007 Malone
2010/0218940 A1 9/2010 Parsche
2010/0219105 A1 9/2010 White et al.
2010/0219108 A1 9/2010 Parsche
2010/0219182 A1 9/2010 Parsche
2010/0219184 A1 9/2010 Parsche
2010/0223011 A1 9/2010 Parsche
2014/0043115 A1* 2/2014 Wright ..... E21B 43/2401 333/243
2015/0083387 A1* 3/2015 Wright ..... E21B 47/122 166/57

OTHER PUBLICATIONS

Atlas Bradford Wellbore Casing, brochure, 2005-2006, 8 pp., Tenaris S.A., available at http://www.tenaris.com/shared/documents/files/CB107.pdf.

* cited by examiner

HYDROCARBON RESOURCE RECOVERY APPARATUS INCLUDING RF TRANSMISSION LINE AND ASSOCIATED METHODS

FIELD OF THE INVENTION

The present invention relates to the field of radio frequency (RF) equipment, and, more particularly, to an RF transmission line, such as, for hydrocarbon resource recovery using RF heating and related methods.

BACKGROUND

To recover a hydrocarbon resource from a subterranean formation, wellbore casings or pipes are typically coupled together in end-to-end relation within the subterranean formation. The wellbore casings are generally rigid and often times made of steel. In order to more efficiently recover a hydrocarbon resource from the subterranean formation, it may be desirable to apply radio frequency (RF) power to the subterranean formation within (or adjacent to) the hydrocarbon resource.

For example, U.S. Pat. No. 8,616,273 to Trautman, et al. and U.S. Pat. No. 8,960,291 to Parsche, which are both assigned to Harris Corporation of Melbourne, Fla., the assignee of the present application, disclose a method of heating a petroleum ore by applying RF energy to a mixture of petroleum ore.

U.S. Patent Application Publication Nos. 2010/0218940 (now U.S. Pat. No. 8,887,810 B2 issue on Nov. 18, 2014), 2010/0219108 (now U.S. Pat. No. 8,133,384 B2 issue on Mar. 13, 2012), 2010/0219184 (now U.S. Pat. No. 8,729,440 B2 issue on May 20, 2014), 2010/0223011 (now U.S. Pat. No. 8,494,775 B2 issue on Jul. 23, 2013), 2010/0219182 (now U.S. Pat. No. 8,674,274 B2 issue on Mar. 18, 2014), also all to Parsche, and all of which are assigned to the assignee of the present application, disclose apparatuses for heating a hydrocarbon resource by RF energy. U.S. Patent Application Publication No. 2010/0219105 (now U.S. Pat. No. 8,128,786 B2 issue on Mar. 6, 2012) to White et al., assigned to the assignee of the present application, discloses a device for RF heating to reduce use of supplemental water added in the recovery of unconventional oil.

As an example of improvements to RF transmission lines, U.S. Pat. No. 8,847,711 to Wright et al., assigned to the assignee of the present application, discloses a series of rigid coaxial sections coupled together in end-to-end relation for use in hydrocarbon resource recovery. Each rigid coaxial section includes an inner conductor and a rigid outer conductor surrounding the inner conductor. Each of the rigid outer conductors includes a rigid outer layer having opposing threaded ends defining overlapping mechanical threaded joints with adjacent rigid outer layers.

U.S. Pat. No. 8,960,272 to Wright et al., also assigned to the assignee of the present application, discloses an RF apparatus for hydrocarbon resource recovery that includes a series of tubular conductors. Each of the tubular conductors may have threads at opposing ends. In addition, the RF apparatus may include bendable tubular dielectric couplers that rotationally interlock opposing ends of the tubular conductors to define a tubular antenna.

To apply the RF energy to the hydrocarbon resource, a rigid coaxial feed arrangement or RF transmission line may be desired to couple to an antenna in the subterranean formation. Typical commercial designs of a rigid coaxial feed arrangement are not generally designed for structural loading or subterranean use, as installation generally requires long runs of the transmission line along the lines of 500-1500 meters. In addition, the transmission line is subjected to significant compressive and tensile loads from thermal expansion and the physical weight of the components of the transmission line.

As an example, a typical overhead transmission line may be capable of 1,000 lbs tension, while it may be desirable for a downhole RF transmission line to have 150,000 to 500,000 lbs tensile capability, which may amount to 150 to 500 times the capacity of an existing commercial product.

In addition, the commercial rigid coaxial designs may be bulky, and require multiple nuts, bolts, washers, and other fasteners to hold the coaxial sections together. Further, larger diameter coaxial sections may limit subterranean uses and a lower profile increases high voltage margins, while reducing antennae bore diameter and wellbore size requirements.

Further improvements to hydrocarbon resource recovery and RF transmission lines may be desirable. For example, it may be desirable to increase the efficiency of assembling a high strength RF transmission line that can withstand relatively high stresses associated with hydrocarbon resource recovery in a subterranean formation.

SUMMARY

In view of the foregoing background, it is therefore an object of the present invention to increase the efficiency of assembling a high strength RF transmission line that can withstand the relatively high stresses associated with hydrocarbon resource recovery in a subterranean formation.

This and other objects, features, and advantages in accordance with embodiments of the invention are provided by an apparatus for hydrocarbon resource recovery from a subterranean formation that may include an RF source, an RF antenna to be positioned within the subterranean formation to deliver RF power to the hydrocarbon resource within the subterranean formation, and an RF transmission line extending between the RF source and the RF antenna. The RF transmission line may include a plurality of RF transmission line sections coupled together in end-to-end relation. Each RF transmission line section may include an inner conductor, an outer conductor surrounding the inner conductor, and an outer load-carrying tubular member surrounding the outer conductor. A respective coupling assembly may join opposing ends of adjacent sections together. Each coupling assembly may include an electrical coupler being fixedly connected to first ends of opposing inner and outer conductors; and being slidably connected to second ends of corresponding inner and outer conductors, and a mechanical coupler connecting opposing ends of adjacent load-bearing tubular members together.

Another aspect is directed to a method for making an RF transmission line to be coupled between an RF source and an RF antenna within a subterranean formation to deliver RF power to a hydrocarbon resource within the subterranean formation. The method may include providing a plurality of RF transmission line sections to be coupled together in end-to-end relation with each RF transmission line section comprising an inner conductor, an outer conductor surrounding the inner conductor, and an outer load-carrying tubular member surrounding the outer conductor. In addition, the method may include using a respective coupling assembly to join opposing ends of adjacent sections together. Each coupling assembly may include an electrical coupler fixedly connected to first ends of corresponding inner and outer conductors and being slidably connected to second ends of opposing inner and outer conductors, and a mechanical coupler connecting opposing ends of adjacent load-bearing tubular members together.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Effective pressure balancing of cooling fluid pumped through the coaxial feed is essential to minimizing cost of copper transmission lines by allowing thin wall tubular. Also, decoupling thermal stresses from thin wall transmission line is highly desirable.

It may thus be desirable to provide a high strength RF transmission line for use in a subterranean formation. More particularly, it may be desirable to provide a high strength RF transmission line that includes efficient non-threaded connections for fragile inner and outer conductors but uses standard connections for the tubular, which can withstand relatively high stresses associated with hydrocarbon resource recovery in a subterranean formation. To address this, one approach uses a tubular with inner and outer conductors carried therein, where the tubular assumes the installation and operational loads rather than the inner and outer conductors.

Figure 1:
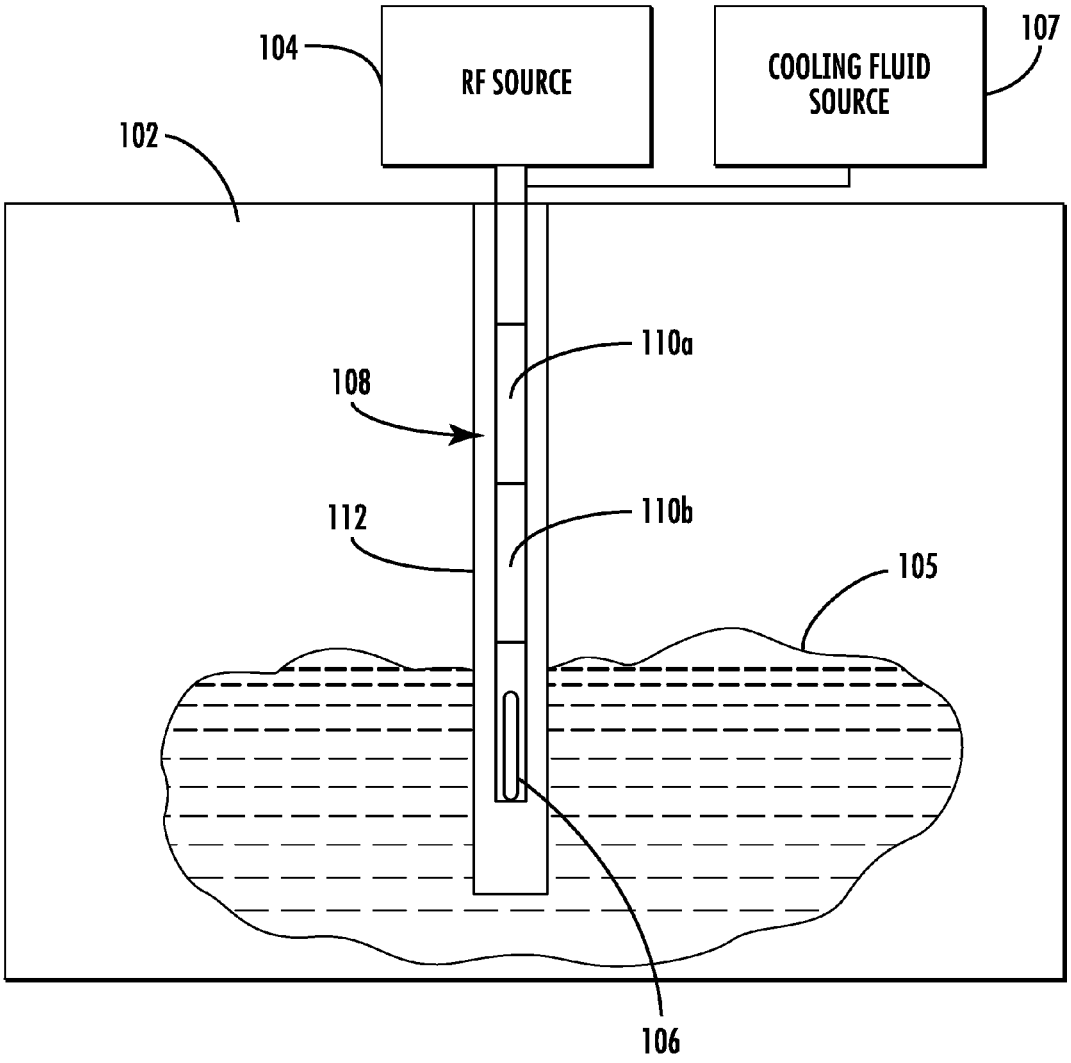
FIG. 1 is a schematic diagram of a subterranean formation including an RF transmission line in accordance with embodiments of the present invention.

Referring initially to FIG. 1, a radio frequency (RF) transmission line 108 is positioned within a wellbore 112 in a subterranean formation 102. The subterranean formation 102 includes hydrocarbon resources 105. The wellbore 112 is illustratively in the form of a vertically extending wellbore 112, for example, as may be particularly advantageous for use with RF assisted hydrocarbon resource recovery techniques. Of course, more than one wellbore 112 and RF transmission line 108 may be used, and/or other techniques for hydrocarbon resource recovery may be used, for example, the steam assisted gravity drainage (SAGD) hydrocarbon resource recovery technique. A separate producer well could be positioned below the wellbore 112. The wellbore 112 could also be horizontal in other embodiments.

The RF transmission line 108 is coupled to an RF source 104 and cooling fluid source 107, which are positioned at the wellhead above the subterranean formation 102. The RF source 104 cooperates with the RF transmission line 108 to transmit RF energy from the RF source 104 to within the subterranean formation 102 and the hydrocarbon resources 105, for example, for heating the subterranean formation 102. An antenna 106 is coupled to the RF transmission line 108 within the wellbore 112. The RF transmission line 108 includes a series of RF transmission line sections 110*a*, 110*b*, for example, each on the order of forty feet in length, coupled together in end-to-end relation.

Figure 2:
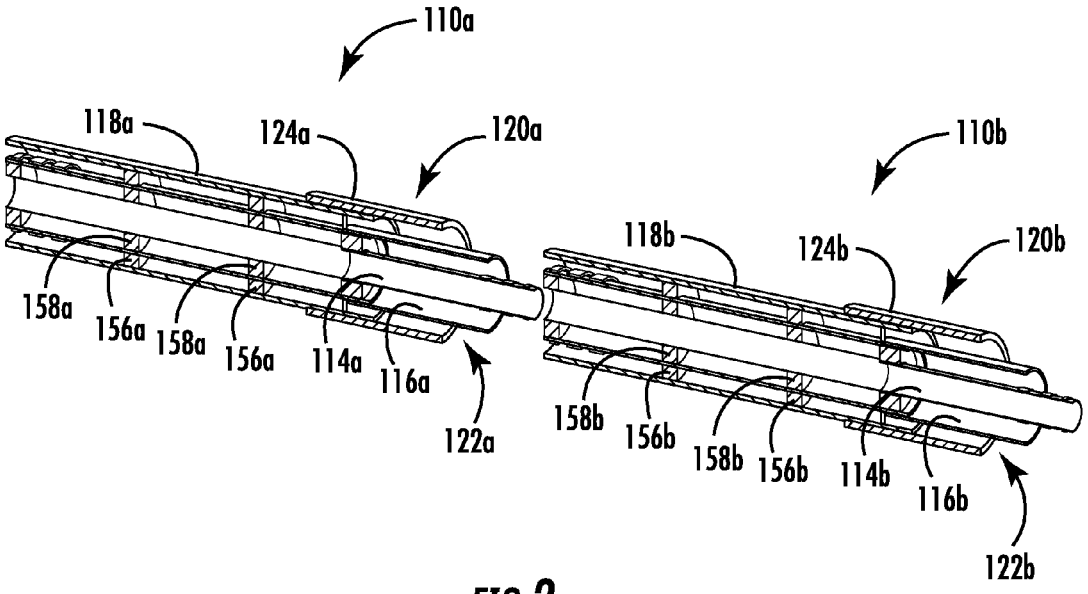
FIG. 2 is a perspective fragmentary view of two RF transmission line sections of the RF transmission line of FIG. 1.

Referring now to FIG. 2, a perspective fragmentary view of the RF transmission line sections 110*a*, 110*b* is provided. The RF transmission line sections 110*a*, 110*b* include a respective inner conductor 114*a*, 114*b*, an outer conductor 116*a*, 116*b* surrounding the respective inner conductor 114*a*, 114*b*, and an outer load-carrying tubular member 118*a*, 118*b* surrounds the respective outer conductor 116*a*, 116*b*. The RF transmission line sections 110*a*, 110*b* also include coupling assemblies 120*a*, 120*b* for joining opposing ends of adjacent RF transmission line sections together. Mechanical couplers 124*a*, 124*b* of the coupling assemblies 120*a*, 120*b* may be used to connect opposing ends of adjacent load-bearing tubular members together as described below.

At least one outer spacer 156*a*, 156*b* is carried by an interior of the respective outer load-bearing tubular member 118*a*, 118*b* and supporting the respective outer conductor 116*a*, 116*b*, where the outer spacer 156*a*, 156*b* includes fluid passageways therethrough connected to the cooling fluid source 107. Similarly, at least one inner spacer 158*a*, 158*b* is carried by an interior of the respective outer conductor 116*a*, 116*b* and supporting the respective inner conductor 114*a*, 114*b*, where the respective inner spacer 158*a*, 158*b* includes fluid passageways also connected to the cooling fluid source 107. The path of the cooling fluid may flow from the cooling fluid source 107 through the inner 114*a*, 114*b* and outer conductors 116*a*, 116*b* and back towards the cooling fluid source 107 (FIG. 1) via a return passageway defined between the tubular 118*a*, 118*b* and the outer conductors 116*a*, 116*b*. Pressure balancing with cooling fluid on both sides of the inner 114*a*, 114*b* and outer conductors 116*a*, 116*b* reduces copper wall thickness allowing for access to deeper reservoirs of hydrocarbon resources 105 (FIG. 1).

The outer load-carrying tubular members 118*a*, 118*b* may be a wellbore casing, which may be available from any number of manufacturers. For example, the outer load-carrying tubular member 118*a*, 118*b* may be steel or stainless steel, and may be a GRANT PRIDECO wellbore casing available from National Oilwell Varco of Houston, Tex., or an ATLAS BRADFORD wellbore casing available from Tenaris S.A. of Liuxembourg. Advantageously, the outer load-carrying tubular members 118*a*, 118*b* of the RF transmission line 108 (FIG. 1) may be formed using a commercial off the shelf (COTS) tubular or well pipe, for example. Additionally, the coupling arrangement between adjacent outer load-carrying tubular members 118*a*, 118*b* may include an exterior interrupt arrangement, a flush interrupt arrangement, a semi-flush interrupt arrangement, or a pin-box-pin arrangement, for example. Of course, other coupling arrangements may be used.

More particularly, the outer load-carrying tubular members 118*a*, 118*b* may have an outer diameter of 5 inches, a maximum tensile strength of 546,787 lbs, and a maximum internal pressure of 12,950 psi. The outer load-carrying tubular members 118*a*, 118*b* may be another type of wellbore casing having different sizes or strength parameters. The outer load-carrying tubular members 118*a*, 118*b*, while being relatively strong, may not be a relatively good conductor compared to copper, for example.

Each coupling assembly 120*a*, 120*b* of the apparatus may include a respective electrical coupler 122*a*, 122*b* being fixedly connected to first ends of corresponding inner 114*a* and respective outer conductors 116*a* and being slidably connected to opposing second ends of adjacent inner 114*b* and outer conductors 116*b*. Some elements of the electrical couplers 122*a*, 122*b* are not shown in FIG. 2 for sake of clarity.

Figure 3:
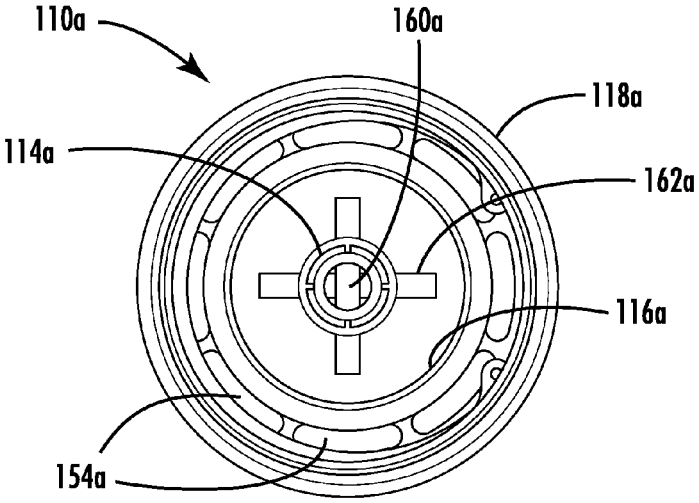
FIG. 3 is an end view of an RF transmission line section of FIG. 2.

Referring now to FIG. 3, the inner conductor 114*a* includes an open interior defining a fluid passageway 160*a* for receiving a cooling fluid from the cooling fluid source 107 (FIG. 1), which is in turn connected to the fluid passageway 160*a* of the inner conductor 114*a*. In addition, an intermediate fluid passageway 162*a* is defined between the outer conductor 116*a* and the inner conductor 114*a*, and an outer fluid passageway 154*a* is similarly defined between the outer load-carrying tubular member 118*a* and the outer conductor 116*a* for receiving the cooling fluid from the cooling fluid source 107 (FIG. 1).

Figure 4:
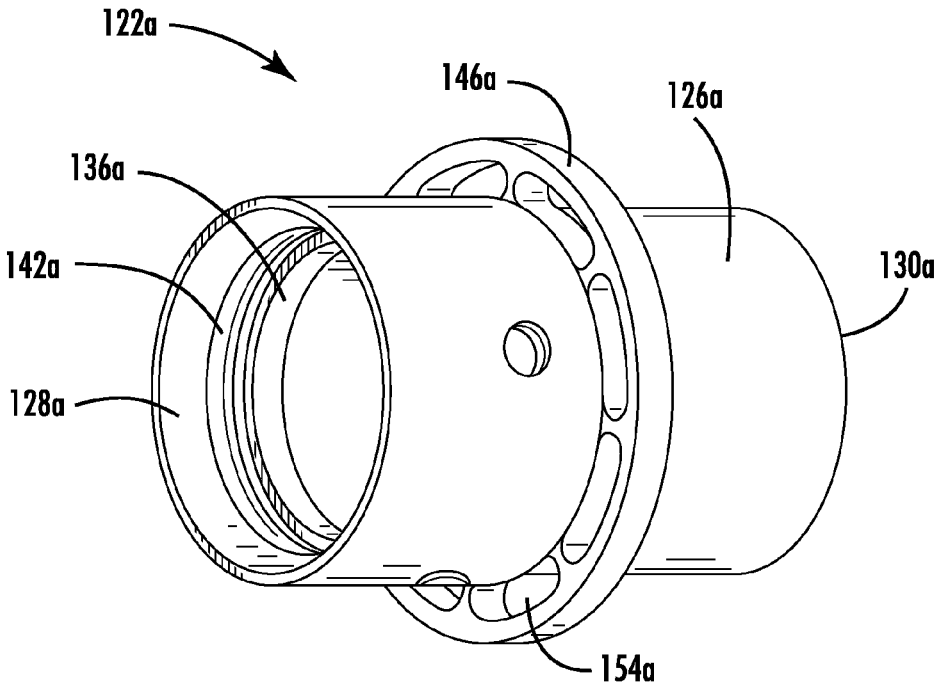
FIG. 4 is a perspective view of an electrical coupler of the two RF transmission line sections of FIG. 2.

Referring now to FIG. 4, the electrical coupler 122*a* includes an outer sleeve 126 a having a respective first end 128*a* to be fixedly connected to the first end of the corresponding outer conductor 116*a* (FIG. 2) and a second end 130*a* to be slidably connected to the second end of the corresponding outer conductor 116*b* (FIG. 2). The electrical coupler 12*a* may also include an outer spacer flange 146*a* received within the outer load-carrying tubular member 118*a* (FIG. 2) and carrying the electrical coupler 122*a*. The mechanical coupler 124 a described above captures the corresponding electrical coupler 122*a* at a first end of the corresponding load-bearing tubular member 118*a* (FIG. 2) The inner 114*a* and outer conductors 116*a* (FIG. 2) are supported at one of the outer load-carrying tubular members and are uncoupled from thermal elastic effects of the outer load-carrying tubular members 118*a*, 118*b* (FIG. 2). The outer load-carrying tubular members 118*a*, 118*b* (FIG. 2) can rotate with respect to the inner 114*a*, 114*b* and outer conductors 116*a*, 116*b* (FIG. 2) to minimize wear. In addition, welds and solder joints may be eliminated by the use of the electrical couplers 122*a*, 122*b* to electrically couple the inner 114*a*, 114*b* and outer conductors 116*a*, 116*b* (FIG. 2) of RF transmission line sections 110*a*, 110*b* together.

The electrical coupler 122*a* may also include at least one contact ring 136*a* within the first end 128*a* of the outer sleeve 126*a*. The contact ring 136*a* may include a watchband conductive spring contact and an expansion spring carried thereby. The electrical coupler 122*a* may also include a fluid seal 142*a* within the first end 128*a* of the outer sleeve 126*a*.

Figure 5:
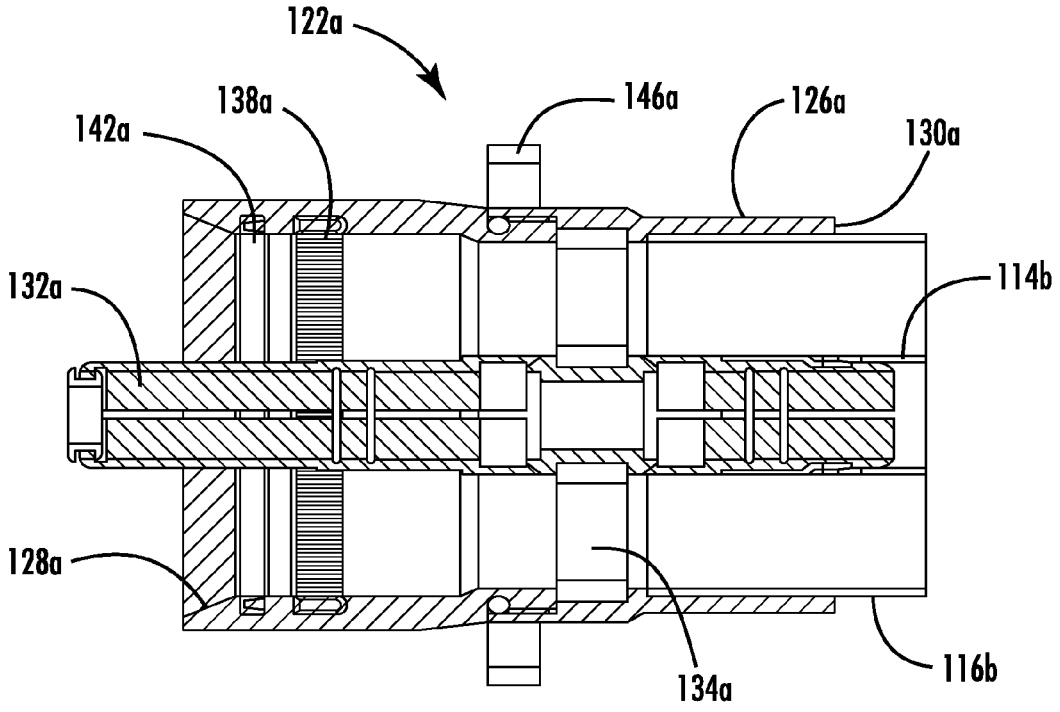
FIG. 5 is a cross-sectional view of the electrical coupler of FIG. 4.

Referring now to FIG. 5, the electrical coupler 122*a* includes an inner contact 132*a* having a first end fixedly connected to the first end of the corresponding inner conductor 114*a* and a second end slidably connected to the opposing second end of the adjacent inner conductor 114*b*. A dielectric spacer 134*a* is received within the outer sleeve 126*a* and supports the inner contact 132*a*. The inner conductor 114*a* may be copper, for example, because of its relatively high conductivity. Of course, the inner conductor 114*a* may be another material, for example, aluminum, nickel, gold, brass, beryllium, or a combination thereof.

Figure 6:
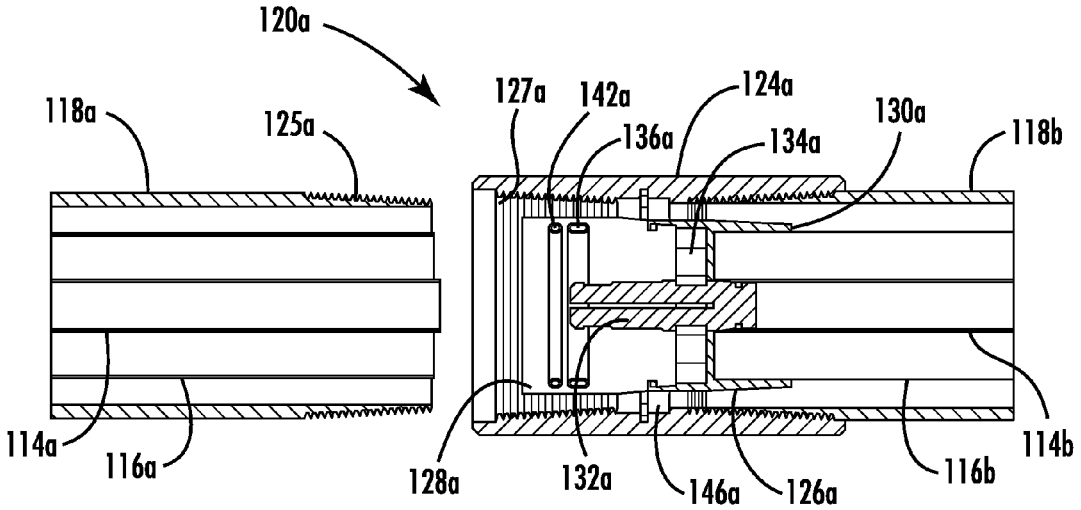
FIG. 6 is a cross-sectional view of a portion of the two RF transmission line sections and coupling assembly of FIG. 2 prior to joining.
Figure 7:
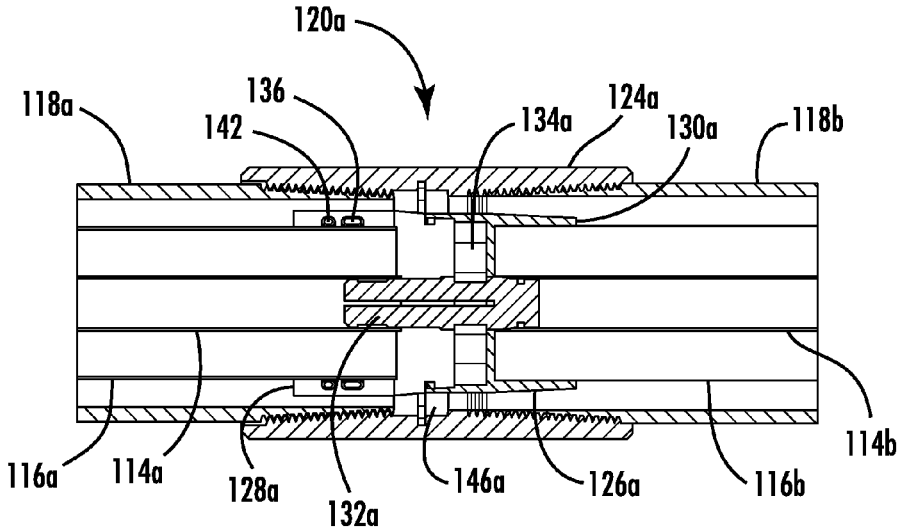
FIG. 7 is a cross-sectional view of the two RF transmission line sections of FIG. 6 after joining.

Referring now to FIGS. 6 and 7, the coupling assembly 120*a* may include the mechanical coupler 124*a* having threads 127*a* for connecting opposing ends of the adjacent load-bearing tubular members 118*a*, 118*b* together, where each of the outer load-carrying tubular members 118*a*, 118*b* includes threaded ends 125*a*, 125*b*. Accordingly, the outer load-carrying tubular members 118*a*, 118*b* are coupled together using the mechanical coupler threads 127*a* defining overlapping mechanical threaded joints.

In another particular illustrative embodiment, a method is directed to making an RF transmission line 108 to be coupled between an RF source 104 and an RF antenna 106 within a subterranean formation 102 to deliver RF power to a hydrocarbon resource 105 within the subterranean formation 102. The method includes forming a plurality of RF transmission line sections 110*a*, 110*b* to be coupled together in end-to-end relation so that each RF transmission line section 110*a*, 110*b* includes a respective inner conductor 114*a*, 114*b*, an outer conductor 116*a*, 116*b* surrounding the respective inner conductor, and an outer load-carrying tubular member 118*a*, 118*b* surrounding the respective outer conductor 116*a*, 116*b*.

The method also includes using a respective coupling assembly 120*a*, 120*b* to join opposing ends of adjacent sections 110*a*, 110*b* together. As described above, each coupling assembly 120*a*, 120*b* may include an electrical coupler 122*a*, 122*b* fixedly connected to first ends of corresponding inner 114*a*, 114*b* and outer conductors 116*a*, 116*b*, and slidably connected to opposing second ends of adjacent inner 114*a*, 114*b* and outer conductors 116*a*, 116*b*. A mechanical coupler 124*a*, 124*b* connects opposing ends of adjacent load-bearing tubular members 118*a*, 118*b* together. In addition, the method includes positioning a contact ring 136*a* within the first end 128*a* of the outer sleeve 126*a* described above, and positioning a fluid seal 142*a* within the first end 128*a* of the outer sleeve 126*a*.

The modular nature of the RF transmission line 108 offloads weight and expansion, and decouples thermal, structural, and weight stresses from thin wall tubes. Moreover, the loads are independent of total length of the RF transmission line 108. Thus, decoupling stresses from the RF transmission line 108 relieves structural stress and allows for smaller wellbore diameter, which directly affects costs of installation of the RF transmission line 108.

Another advantage of the RF transmission line 108 is that it uses a sliding interface rather than threads between the ends of adjacent inner 114*a*, 114*b* and outer conductors 116*a*, 116*b* so that the rig does not require rotation during assembly of the RF transmission line 108. Also, visual inspection for coupling the inner 114*a*, 114*b* and outer conductors 116*a*, 116*b* into the respective electrical coupler 122*a*, 122*b* is permitted. The sliding interface also reduces part count and complexity, and reduces installation time on the rig, which greatly increases the efficiency of assembling the high strength RF transmission line 108 and reduces installation costs of the RF transmission line 108.

Of course, the RF transmission line embodiments as described herein may have application other than for hydrocarbon resource recovery in a subterranean formation as described above. For example, the RF transmission line may be used in any long transmission line run with a significant amount of power (heat) variations. The transmission line could be strung along towers, up tall buildings or coupled among wellheads hundreds of meters apart. High power runs may heat substantially and the temperatures in certain locations can fluctuate fairly drastically between seasons, and this might account for variations in the ground/support structures moving by isolating the loads. In addition, many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An apparatus for hydrocarbon resource recovery from a subterranean formation comprising:

a radio frequency (RF) source;

an RF antenna to be positioned within the subterranean formation to deliver RF power to the hydrocarbon resource within the subterranean formation;

an RF transmission line extending between said RF source and said RF antenna;

said RF transmission line comprising a plurality of RF transmission line sections coupled together in end-to-end relation;

each RF transmission line section comprising an inner conductor, an outer conductor surrounding said inner conductor, and an outer load-bearing tubular member surrounding said outer conductor;

a respective coupling assembly joining opposing ends of adjacent RF transmission line sections together, each coupling assembly comprising an electrical coupler being fixedly connected to first ends of corresponding inner and outer conductors and being slidably connected to opposing second ends of adjacent inner and outer conductors, and a mechanical coupler connecting opposing ends of adjacent outer load-bearing tubular members together, said electrical coupler comprising an outer sleeve having a first end fixedly connected to the first end of the corresponding outer conductor and a second end slidably connected to the opposing second end of the adjacent outer conductor, an inner contact having a first end fixedly connected to the first end of the corresponding inner conductor and a second end slidably connected to the opposing second end of the adjacent inner conductor, a dielectric inner spacer received within said outer sleeve and supporting said inner contact, and a contact ring within the second end of said outer sleeve.

2. The apparatus according to claim 1 wherein each inner conductor has an open interior defining a fluid passageway; and further comprising a cooling fluid source connected to the fluid passageway of each inner conductor.

3. The apparatus according to claim 2 further comprising at least one outer spacer carried by an interior of each outer load-bearing tubular member and supporting each outer conductor; and wherein said at least one outer spacer has a plurality of passageways therethrough connected to said cooling fluid source.

4. The apparatus according to claim 1 wherein said contact ring comprises a watchband conductive spring contact and an expansion spring carried thereby.

5. The apparatus according to claim 1 further comprising a fluid seal within the second end of each outer sleeve.

6. The apparatus according to claim 1 wherein each mechanical coupler captures a corresponding electrical coupler at a first end of the corresponding load-bearing tubular member.

7. The apparatus according to claim 1 wherein said respective coupling assembly further comprises an outer spacer flange received within said outer load-carrying tubular member and carrying said electrical coupler.

8. The apparatus according to claim 1 wherein each outer load-bearing tubular member comprises steel; and wherein said inner and outer conductors each comprises copper.

9. A radio frequency (RF) transmission line to be coupled between an RF source and an RF antenna within a subterranean formation to deliver RF power to a hydrocarbon resource within the subterranean formation, the RF transmission line comprising:

a plurality of RF transmission line sections coupled together in end-to-end relation within the subterranean formation;

each RF transmission line section comprising an inner conductor, an outer conductor surrounding said inner conductor, and an outer load-bearing tubular member surrounding said outer conductor;

a respective coupling assembly joining opposing ends of adjacent RF transmission line sections together, each coupling assembly comprising an electrical coupler being fixedly connected to first ends of corresponding inner and outer conductors and being slidably connected to opposing second ends of adjacent inner and outer conductors, and a mechanical coupler connecting opposing ends of adjacent load-bearing tubular members together, said mechanical coupler capturing a corresponding electrical coupler at a first end of the corresponding load-bearing tubular member.

10. The RF transmission line according to claim 9 wherein each outer load-bearing tubular member comprises steel; and wherein said inner and outer conductors each comprises copper.

11. A radio frequency (RF) transmission line to be coupled between an RF source and an RF antenna, the RF transmission line comprising:

a plurality of RF transmission line sections coupled together in end-to-end relation;

each RF transmission line section comprising an inner conductor, an outer conductor surrounding said inner conductor, and an outer load-bearing tubular member surrounding said outer conductor;

a respective coupling assembly joining opposing ends of adjacent RF transmission line sections together, each coupling assembly comprising an electrical coupler being fixedly connected to first ends of corresponding inner and outer conductors and being slidably connected to opposing second ends of adjacent inner and outer conductors, and a mechanical coupler connecting opposing ends of adjacent outer load-bearing tubular members together, said electrical coupler comprising an outer sleeve having a first end fixedly connected to the first end of the corresponding outer conductor and a second end slidably connected to the opposing second end of the adjacent outer conductor, an inner contact having a first end fixedly connected to the first end of the corresponding inner conductor and a second end slidably connected to the opposing second end of the adjacent inner conductor, a dielectric inner spacer received within said outer sleeve and supporting said inner contact, and a contact ring within the second end of said outer sleeve.

12. The RF transmission line according to claim 11 wherein said contact ring comprises a watchband conductive spring contact and an expansion spring carried thereby.

13. The RF transmission line according to claim 11 further comprising a fluid seal within the second end of each outer sleeve.

14. The RF transmission line according to claim 11 wherein each mechanical coupler captures a corresponding electrical coupler at a first end of the corresponding load-bearing tubular member.

15. The RF transmission line according to claim 11 wherein said respective coupling assembly further comprises an outer spacer flange received within said outer load-bearing tubular member and carrying said electrical coupler.

16. The RF transmission line according to claim 11 wherein each outer load-bearing tubular member comprises steel; and wherein said inner and outer conductors each comprises copper.

17. A method for making a radio frequency (RF) transmission line to be coupled between an RF source and an RF antenna within a subterranean formation to deliver RF power to a hydrocarbon resource within the subterranean formation, the method comprising:

providing a plurality of RF transmission line sections to be coupled together in end-to-end relation with each RF transmission line section comprising an inner conductor, an outer conductor surrounding the inner conductor, and an outer load-carrying tubular member surrounding the outer conductor;

using a respective coupling assembly to join opposing ends of adjacent RF transmission line sections together, each coupling assembly comprising an electrical coupler being fixedly connected to first ends of corresponding inner and outer conductors and being slidably connected to opposing second ends of adjacent inner and outer conductors, and a mechanical coupler connecting opposing ends of adjacent outer load-bearing tubular members together, the electrical coupler comprising an outer sleeve having a first end fixedly connected to the first end of the corresponding outer conductor and a second end slidably connected to the opposing second end of the adjacent outer conductor, an inner contact having a first end fixedly connected to the first end of the corresponding inner conductor and a second end slidably connected to the opposing second end of the adjacent inner conductor, a dielectric inner spacer received within the outer sleeve and supporting the inner contact, and a contact ring within the second end of the outer sleeve.

18. The method according to claim 17 further comprising positioning a fluid seal within the second end of each outer sleeve.

19. The method according to claim 17 wherein each mechanical coupler captures a corresponding electrical coupler at a first end of the corresponding load-bearing tubular member.

20. A radio frequency (RF) transmission line to be coupled between an RF source and an RF antenna within a subterranean formation to deliver RF power to a hydrocarbon resource within the subterranean formation, the RF transmission line comprising:

a plurality of RF transmission line sections coupled together in end-to-end relation within the subterranean formation;

each RF transmission line section comprising an inner conductor, an outer conductor surrounding said inner conductor, and an outer load-bearing tubular member surrounding said outer conductor;

a respective coupling assembly joining opposing ends of adjacent RF transmission line sections together, each coupling assembly comprising an electrical coupler being fixedly connected to first ends of corresponding inner and outer conductors and being slidably connected to opposing second ends of adjacent inner and outer conductors, said electrical coupler comprising an outer sleeve having a first end fixedly connected to the first end of the corresponding outer conductor and a second end slidably connected to the opposing second end of the adjacent outer conductor, an inner contact having a first end fixedly connected to the first end of the corresponding inner conductor and a second end slidably connected to the opposing second end of the adjacent inner conductor, a contact ring within the second end of said outer sleeve, and a dielectric inner spacer received within said outer sleeve and supporting said inner contact, and a mechanical coupler connecting opposing ends of adjacent outer load-bearing tubular members together.

21. The RF transmission line according to claim 20 wherein said contact ring comprises a watchband conductive spring contact and an expansion spring carried thereby.

22. The RF transmission line according to claim 20 wherein each outer load-bearing tubular member comprises steel; and wherein said inner and outer conductors each comprises copper.

23. A radio frequency (RF) transmission line to be coupled between an RF source and an RF antenna within a subterranean formation to deliver RF power to a hydrocarbon resource within the subterranean formation, the RF transmission line comprising:

a plurality of RF transmission line sections coupled together in end-to-end relation within the subterranean formation;

each RF transmission line section comprising an inner conductor, an outer conductor surrounding said inner conductor, and an outer load-bearing tubular member surrounding said outer conductor;

a respective coupling assembly joining opposing ends of adjacent RF transmission line sections together, each coupling assembly comprising an electrical coupler being fixedly connected to first ends of corresponding inner and outer conductors and being slidably connected to opposing second ends of adjacent inner and outer conductors, said electrical coupler comprising an outer sleeve having a first end fixedly connected to the first end of the corresponding outer conductor and a second end slidably connected to the opposing second end of the adjacent outer conductor, an inner contact having a first end fixedly connected to the first end of the corresponding inner conductor and a second end slidably connected to the opposing second end of the adjacent inner conductor, a fluid seal within the second end of said outer sleeve, and a dielectric inner spacer received within said outer sleeve and supporting said inner contact, and a mechanical coupler connecting opposing ends of adjacent outer load-bearing tubular members together.

24. The RF transmission line according to claim 23 wherein each outer load-bearing tubular member comprises steel; and wherein said inner and outer conductors each comprises copper.

25. A radio frequency (RF) transmission line to be coupled between an RF source and an RF antenna within a subterranean formation to deliver RF power to a hydrocarbon resource within the subterranean formation, the RF transmission line comprising:

a plurality of RF transmission line sections coupled together in end-to-end relation within the subterranean formation;

each RF transmission line section comprising an inner conductor, an outer conductor surrounding said inner conductor, and an outer load-bearing tubular member surrounding said outer conductor;

a respective coupling assembly joining opposing ends of adjacent RF transmission line sections together, each coupling assembly comprising an electrical coupler being fixedly connected to first ends of corresponding inner and outer conductors and being slidably connected to opposing second ends of adjacent inner and outer conductors, a mechanical coupler connecting opposing ends of adjacent outer load-bearing tubular members together, and an outer spacer flange received within said outer load-bearing tubular member and carrying said electrical coupler.

26. The RF transmission line according to claim 25 wherein each outer load-bearing tubular member comprises steel; and wherein said inner and outer conductors each comprises copper.

* * * * *